US008857417B2

(12) United States Patent
Takano

(10) Patent No.: US 8,857,417 B2
(45) Date of Patent: Oct. 14, 2014

(54) ENGINE FOR VEHICLE

(75) Inventor: Kiyohito Takano, Kobe (JP)

(73) Assignee: Kawasaki Jukogyo Kabushiki Kaisha, Hyogo (JP)

( * ) Notice: Subject to any disclaimer, the term of this patent is extended or adjusted under 35 U.S.C. 154(b) by 534 days.

(21) Appl. No.: 12/649,771

(22) Filed: Dec. 30, 2009

(65) Prior Publication Data

US 2011/0155082 A1 Jun. 30, 2011

(51) Int. Cl.
*F02B 25/06* (2006.01)
*F01M 13/04* (2006.01)
*F02B 75/22* (2006.01)

(52) U.S. Cl.
CPC ..... *F01M 13/04* (2013.01); *F02B 75/22* (2013.01); *F01M 2013/0461* (2013.01)
USPC ..... 123/572; 123/573; 123/574; 123/41.86; 123/195 R

(58) Field of Classification Search
USPC ..... 123/572, 195 R, 573, 574, 41.86
See application file for complete search history.

(56) References Cited

U.S. PATENT DOCUMENTS 4,103,650 A * 8/1978 Nishida et al. ..... 123/41.86
4,468,979 A * 9/1984 Inagaki et al. ..... 74/606 R
4,854,919 A * 8/1989 van Lith ..... 474/25
5,970,931 A * 10/1999 Kawarabata ..... 123/90.31
7,334,556 B2 * 2/2008 Wachigai et al. ..... 123/195 HC
7,438,031 B2 * 10/2008 Kono et al. ..... 123/90.12
7,694,597 B2 * 4/2010 Nishi et al. ..... 74/325
7,743,758 B2 * 6/2010 Keyaki et al. ..... 123/574
7,802,647 B2 * 9/2010 Ishida ..... 180/230
8,104,374 B2 * 1/2012 Matsubara et al. ..... 74/606 R
2002/0005191 A1 * 1/2002 Maeda et al. ..... 123/572
2002/0104504 A1 * 8/2002 Suzuki et al. ..... 123/195 R
2004/0200462 A1 * 10/2004 Hara ..... 123/572
2004/0231925 A1 * 11/2004 Matsushima ..... 184/6.23
2008/0022981 A1 * 1/2008 Keyaki et al. ..... 123/574
2008/0041179 A1 * 2/2008 Yasui et al. ..... 74/467
2009/0241880 A1 * 10/2009 Tsubakino et al. ..... 123/90.39

FOREIGN PATENT DOCUMENTS

JP 2009243439 A * 10/2009

* cited by examiner

*Primary Examiner* — Marguerite McMahon
*Assistant Examiner* — James Kim
(74) *Attorney, Agent, or Firm* — Wenderoth, Lind & Ponack, L.L.P.

(57) ABSTRACT

A breather structure is for an engine of a vehicle provided with a V-belt type continuously variable transmission. The engine includes a crankcase having a crank chamber and a gear transmission chamber, and a V-belt transmission case housing the V-belt type continuously variable transmission, the V-belt transmission case being fastened to an attachment surface on one side of the crankcase in the crankshaft direction. A breather chamber is formed in a mating part between the attachment surface of the crankcase and an attached surface of the V-belt transmission case. This breather chamber separates the air containing oil mist in the crankcase into a gas component and an oil component, discharges the gas component to the exterior of the crankcase, and returns the oil component to the interior of the transmission chamber.

7 Claims, 12 Drawing Sheets

ENGINE FOR VEHICLE

BACKGROUND OF THE INVENTION

1. Field of the Invention

The present invention relates to an engine for a vehicle, particularly to an engine for a vehicle provided with a breather chamber.

2. Description of the Related Art

A breather chamber of an engine for a vehicle has a function of separating the air (blow-by gas) including oil mist in a crankcase into gas and liquid, returning an oil component to the interior of the engine, and discharging a gas component to the exterior of the crankcase.

Japanese Patent Application No. 2008-332653 discloses an engine for a vehicle having a breather chamber. The breather chamber is provided on the upper side of a crankcase. The crankcase is dividable into left and right crankcase members at vertical mating surfaces (division surfaces), and the breather chamber is formed by the mating surfaces of both the crankcase members.

In an engine for a vehicle provided with a crankcase dividable into upper and lower crankcase members at horizontal mating surfaces (division surfaces), a breather chamber is added onto an upper surface of the upper crankcase member, or a breather chamber is formed by the mating surfaces of the upper and lower crankcase members.

3. Problems to be Solved by the Invention

As in the former engine for the vehicle described above, when the breather chamber is formed by the mating surfaces of the left and right crankcase members, the breather chamber is arranged in a center part of width of a transmission chamber housing a gear type transmission in the crankshaft direction, so that the capacity of the breather chamber is limited.

Meanwhile, as in the latter engine for the vehicle described above, when the breather chamber is added onto an upper part of the crankcase, a starter and the like to be arranged onto the upper part of the crankcase are arranged at higher positions, and thus the total length of the engine is increased. Particularly, since a rear cylinder inclined rearward is positioned on the upper side of the crankcase in a V-type engine, the capacity of the breather chamber is largely limited.

When the breather chamber is provided in the exterior of the crankcase, a case and a cover exclusive to the breather chamber are required and a pipe for retuning oil is also required. Thus, part cost is increased and the man-hours required for assembling the engine are also increased.

SUMMARY OF THE INVENTION

The present invention is achieved in consideration of the problems above, and an object of the present invention is to provide an engine for a vehicle capable of maintaining compact size of the engine in the up and down direction, the fore-aft direction and the left and right direction while providing a large-capacity breather chamber. Another object of the present invention is to reduce the number of parts for the breather chamber.

In order to solve the problems above, an engine for a vehicle according to the present invention includes a crankcase having a crank chamber housing a crankshaft, and a gear transmission chamber housing a gear type transmission, a V-belt transmission case housing a V-belt type continuously variable transmission (CVT) for transmitting mechanical power from the crankshaft to an input shaft of the gear type transmission, the V-belt transmission case being fastened to an attachment surface on one side of the crankcase in the crankshaft direction, and a breather chamber formed in a mating part between the attachment surface of the crankcase and an attached surface of the V-belt transmission case, the breather chamber separating the air containing oil mist in the crankcase into a gas component and an oil component, discharging the gas component to the exterior of the crankcase through an discharge port, and returning the oil component to the interior of the transmission chamber.

According to the configuration above, the breather chamber can be provided without having the crankcase projecting toward the upper side and the rear side of the engine. Thus, it is possible to maintain compact size of the engine in the fore-aft direction and height thereof while increasing capacity of the breather chamber.

Since a case and a cover exclusive for forming the breather chamber are not required, it is possible to reduce the number of the parts, part cost and manufacturing cost.

In addition to the configuration above, the present invention may preferably have the following characteristics.

(a) The gear type transmission includes a reverse gear row in the vicinity of a side wall thereof on the opposite side of the V-belt transmission case, and the breather chamber is positioned so as to face the reverse gear row seen in the crankshaft direction.

According to the configuration above, space generated on the side of the reverse gear row can be effectively utilized for the breather chamber. Thus, it is possible to prevent an increase in size of the engine in the crankshaft direction.

(b) The V-belt type continuously variable transmission includes a drive pulley positioned on the side of the crankshaft, a driven pulley positioned on the side of the input shaft, and a V belt looped over both the pulleys, and the breather chamber is positioned between the drive pulley and the driven pulley seen in the crankshaft direction.

According to the configuration above, extra space between the front and rear pulleys can be effectively utilized for the breather chamber. Thus, it is possible to provide the large-capacity breather chamber.

(c) A discharge port for discharging the gas component after separation is formed in the V-belt transmission case.

Although a rubber tube or the like is connected to the discharge port in general, according to the configuration above, the rubber tube can be placed distant from the cylinders in comparison to a case where the discharge port is formed in the crankcase, so that a thermal influence to the rubber tube can be reduced. Particularly, since the rear cylinder is inclined on the upper side of the crankcase in a V-type engine, there is a need for taking a thermal influence of the rear cylinder into account. However, by adapting the configuration above, it is possible to reduce the thermal influence.

(d) The engine further includes a clutch chamber housing a centrifugal clutch for turning ON/OFF mechanical power transmission from the crankshaft to the V-belt type continuously variable transmission on one side of the crank chamber in the crankshaft direction, and a generator chamber housing a generator on the other side, the clutch chamber, the generator chamber and the crank chamber communicating with each other through communication holes. A pre-breather chamber is formed in a center part of the crankcase in the width direction, and blow-by gas from the clutch chamber and the generator chamber is firstly gathered in the pre-breather chamber and then fed to the breather chamber.

According to the configuration above, the oil mist scattered from a clutch in the clutch chamber and the oil mist scattered in the generator chamber are not directly guided to the breather chamber. Thus, it is possible to prevent a decrease in a breather function.

(e) A front cylinder inclined forward and a rear cylinder inclined rearward can be fastened to the crankcase by V-type arrangement.

BRIEF DESCRIPTION OF THE DRAWINGS

The above and other objects, features and advantages of the present invention will be become more apparent from the following description taken in connection with the accompanying drawings.

DETAILED DESCRIPTION OF THE PREFERRED EMBODIMENTS

[First Embodiment of the Invention]

FIGS. 1 to 9 show an engine for a vehicle according to an embodiment of the present invention and a four-wheeled vehicle equipped with the engine. The embodiment of the present invention will be described based on the drawings.

Figure 1:
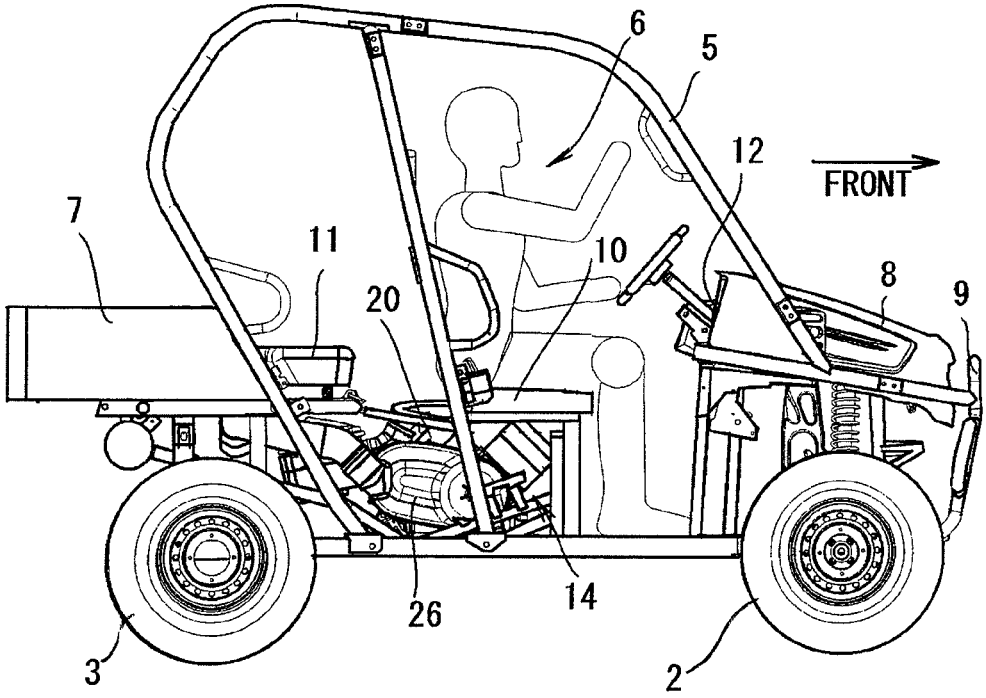
FIG. 1 is a right side view of a small-sized four-wheeled vehicle for irregular terrain (a so-called utility vehicle) equipped with an engine for a vehicle according to a first embodiment of the present invention.

FIG. 1 is a right side view of the four-wheeled vehicle. This small-sized four-wheeled vehicle for irregular terrain (a so-called utility vehicle) is provided with a pair of left and right front wheels 2 in a front part of a vehicle frame 1, a pair of left and right rear wheels 3 in a rear part of the vehicle frame 1, a cabin 6 surrounded by a cabin frame 5 between the front wheels 2 and the rear wheels 3, a loading platform 7 on the rear side of the cabin 6, and a bonnet 8, a bumper 9 and the like on the front side of the cabin 6.

A front seat 10 formed in a bench shape or a left-right division shape is installed in a front half part in the cabin 6, a rear seat 11 formed in a bench shape or a left-right division shape is installed in a rear half part in the cabin 6, and a dashboard (an operation portion) 12 is provided in a front end of the cabin 6.

An engine room 14 is formed so as to extend from lower space of the front seat 10 to lower space of the rear seat 11 and also positioned in a substantially center part of the vehicle in the width direction. A V-type two-cylinder engine 20 is housed in this engine room 14. A V-belt transmission case 26 is attached to a right side surface of the engine 20.

Figure 2:
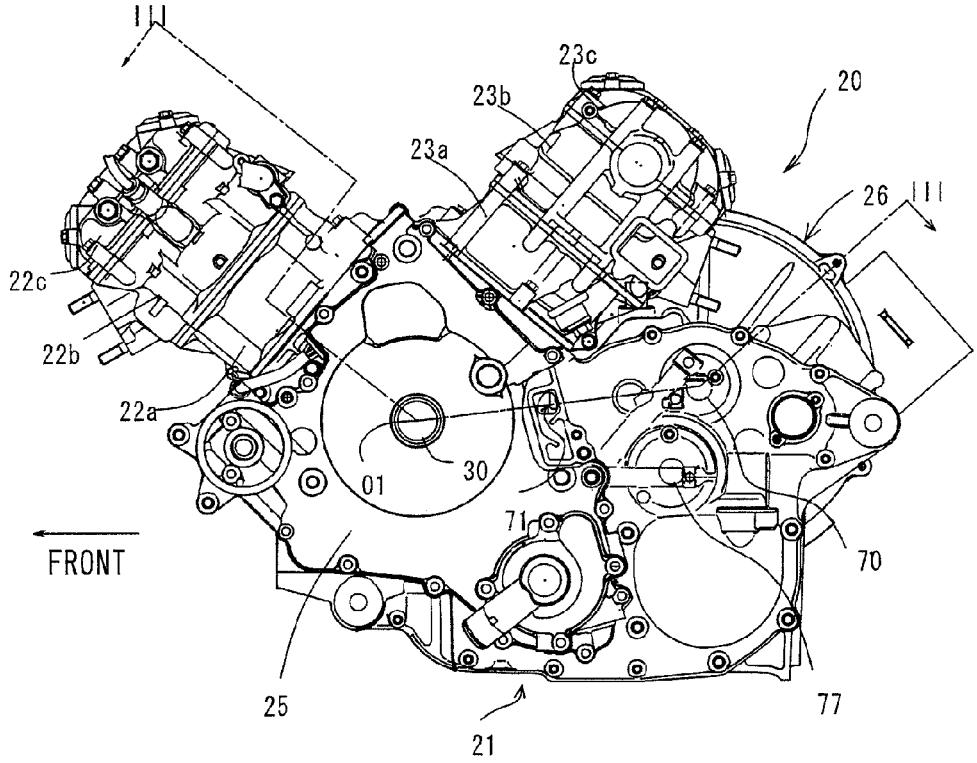
FIG. 2 is a left side view of the engine in FIG. 1.

FIG. 2 is a left side view of the V-type two-cylinder engine. A front cylinder 22*a* inclined forward and a rear cylinder 23*a* inclined rearward are fastened to an upper end of a front part of a crankcase 21 by V-type arrangement. Cylinder heads 22*b*, 23*b* and head covers 22*c*, 23*c* are fastened to upper ends of the cylinders 22*a*, 23*a*. A generator cover 25 is attached to a left side surface of a front half part of the crankcase 21, and the V-belt transmission case 26 is attached to a right side surface of the crankcase 21 as described above.

Figure 3:
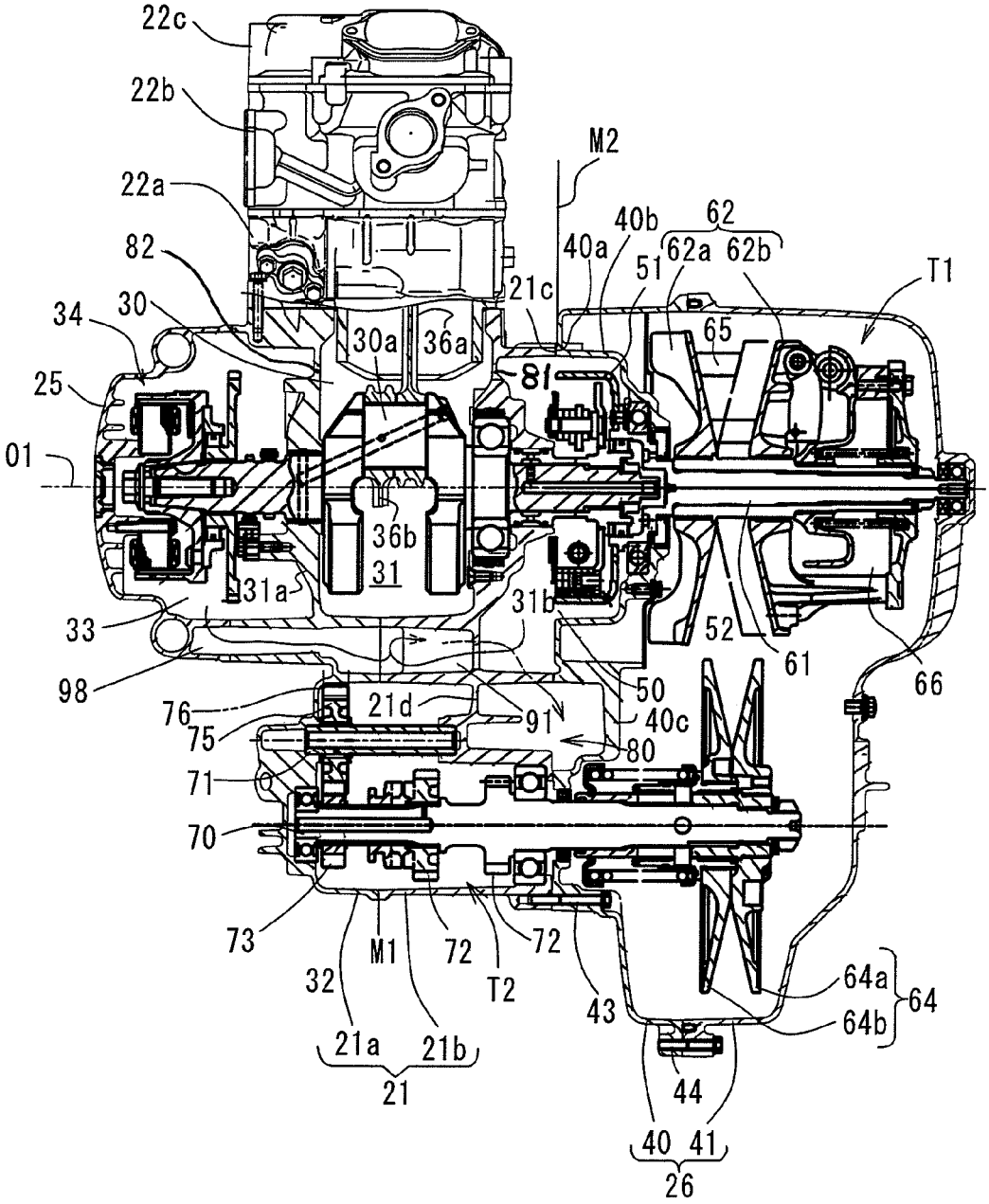
FIG. 3 is a sectional view by the line III-III in FIG. 2.

FIG. 3 is a sectional view by the line in FIG. 2. The crankcase 21 is divided into left and right parts at vertical mating surface (division surface) M1. The crankcase 21 includes a left crankcase member 21*a* and a right crankcase member 21*b*.

The crankcase 21 has a crank chamber 31 housing a crankshaft 30 in the front half part thereof, and a transmission chamber 32 housing a gear-type transmission (only a part thereof is shown in the figure) T2 in a rear half part thereof. Further, the crankcase 21 has a generator chamber 33 covered by the generator cover 25 on the left side of a left side wall 31*a* of the crank chamber 31, and a generator 34 is arranged in this generator chamber 33.

A crank pin 30*a* of the crankshaft 30 is fitted to a pair of connection rods 36*a*, 36*b* for the front and rear cylinders. A left end of the crankshaft 30 extends into the generator chamber 33, and a rotor of the generator 34 is fixed to the left end of the crankshaft 30.

The V-belt transmission case 26 arranged on the right side of the crankcase 21 includes a case main body 40 and a case cover 41. A V-belt type continuously variable transmission T1 is housed in the V-belt transmission case 26.

A right side surface of the right crankcase member 21*b* is an attachment surface 21*c* for attachment of the V-belt transmission case 26. The attachment surface 21*c* mates with an attached surface 40*a* of the case main body 40. The case main body 40 is attached to the right crankcase member 21*b* by a plurality of bolts 43. The case cover 41 is attached to a right side surface of the case main body 40 by a plurality of bolts 44.

A clutch chamber 50 surrounded by a right side wall 31*b* of the crank chamber 31 and a concave portion 40*b* of the case main body 40 is provided on the right side of the crank chamber 31. A centrifugal clutch 51 is housed in the clutch chamber 50. A clutch shaft 52 on the input side of the centrifugal clutch 51 is formed integrally with the crankshaft 30. The axis of the clutch shaft 52 corresponds to the axis 01 of the crankshaft 30.

The V-belt type continuously variable transmission T1 housed in the V-belt transmission case 26 plays a role of a primary transmission, and a structure thereof is already known. Therefore, the V-belt type continuously variable transmission T1 will be briefly described. The V-belt type continuously variable transmission T1 includes a drive pulley 62 attached to a drive shaft 61, a driven pulley 64 attached to a driven shaft 63, and a V belt 65 looped over both the pulleys 62, 64. The drive shaft 61 is combined to a clutch housing on the output side of the centrifugal clutch 51, and the driven shaft 63 is formed integrally with a transmission input shaft 70 of the gear-type transmission T2. The drive pulley 62 has a fixed sheave 62*a*, a movable sheave 62*b*, and a sheave thrust force generating mechanism 66 of a flyweight type. The driven pulley 64 has a fixed sheave 64*a* and a moveable sheave 64*b*. In accordance with a change in rotation speed of the drive shaft 61, a gap between both the sheaves 62*a*, 62*b* of the drive pulley 62 and a gap between both the sheaves 64*a*, 64*b* of the driven pulley 64 are changed so as to automatically shift gears.

The gear-type transmission T2 is provided with the transmission input shaft 70, a transmission output shaft 77 (refer to FIGS. 2 and 7), and a reverse idle shaft 71 (i.e. a rear idle shaft). The transmission input shaft 70 is provided with two input transmission gears 72, 72 for forward movement, and one input reverse gear 73. The reverse idle shaft 71 is provided with a reverse idle gear 75 to be meshed with the input reverse gear 73. The transmission output shaft 77 (refer to FIGS. 2 and 7) is provided with output transmission gears to be meshed with the transmission gears 72, 72 for forward movement, and an output reverse gear 76 to be meshed with the reverse idle gear 75.

The input reverse gear 73, the reverse idle gear 75, and the output reverse gear 76 are arranged in a single row on a single vertical plane and placed as leftward as possible so as to be positioned in the vicinity of a left side wall of the transmission chamber 32.

A wall part 21*d* of the right crankcase member 21*b* facing the reverse idle gear 75 seen in the crankshaft direction is dented leftward by a fixed amount from the attachment surface 21*c* (one of mating surfaces M2) of the right crankcase member 21*b*. A wall part 40*c* of the case main body 40 facing the reverse idle gear 75 is dented rightward from the attached surface 40*a* (the other mating surface M2) of the case main body 40. The wall part 21*d* of the right crankcase member 21*b* and the wall part 40*c* of the case main body 40 form a main breather chamber 80 serving as a major part of the present invention. That is, the main breather chamber 80 is formed by the mating surfaces M2 of the case main body 40 and the right crankcase member 21*b*. This main breather chamber 80 is positioned between the drive pulley 62 and the driven pulley 64 of the V-belt continuously variable transmission T1 so as to face the reverse idle gear 75 seen in the crankshaft direction.

[Breather Structure]

In FIG. 3, a communication hole 81 (FIG. 8) providing communication between the crank chamber 31 and the clutch chamber 50 for feeding blow-by gas is provided in the right side wall 31*b* of the crank chamber 31. A communication hole 82 providing communication between the crank chamber 31 and the generator chamber 33 for feeding the blow-by gas is provided in the left side wall 31*a* of the crank chamber 31.

Figure 6:
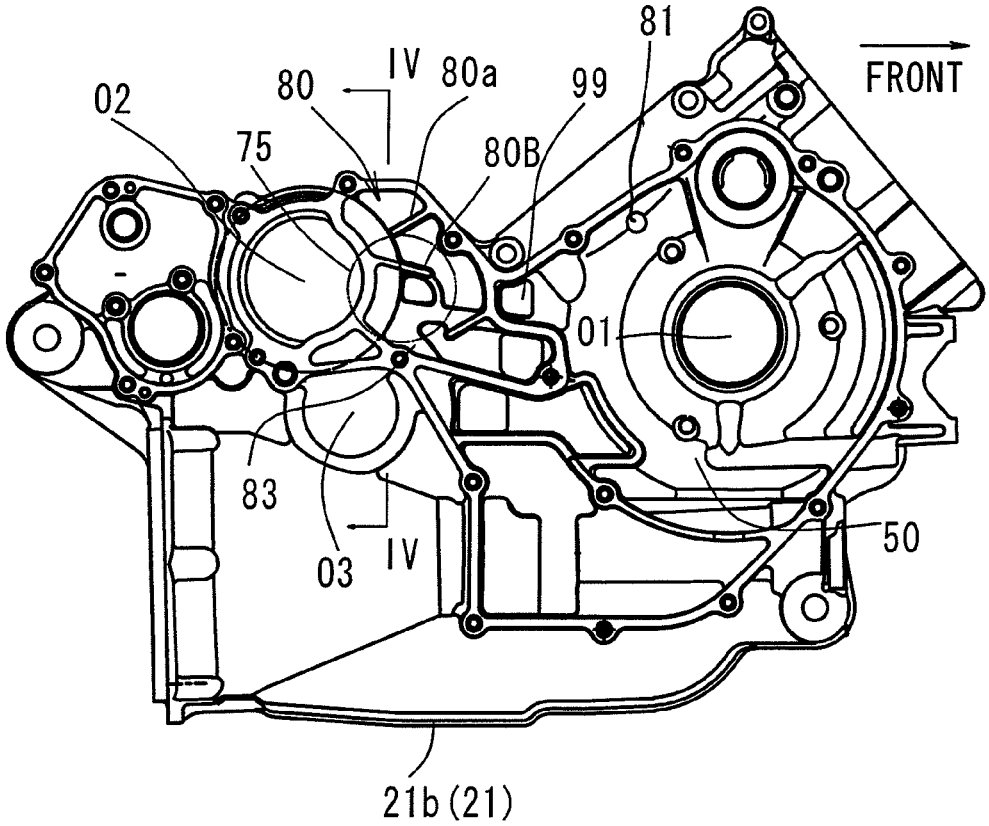
FIG. 6 is a right side view (an exterior view) of a right crankcase member of the engine in FIG. 1.

FIG. 6 shows the right side surface (an external surface) of the right crankcase member 21*b*. This right crankcase member 21*b* forms a substantially left half of the main breather chamber 80. A described above, the main breather chamber 80 is positioned so as to face the reverse idle gear 75 seen in the crankshaft direction as described above.

Figure 8:
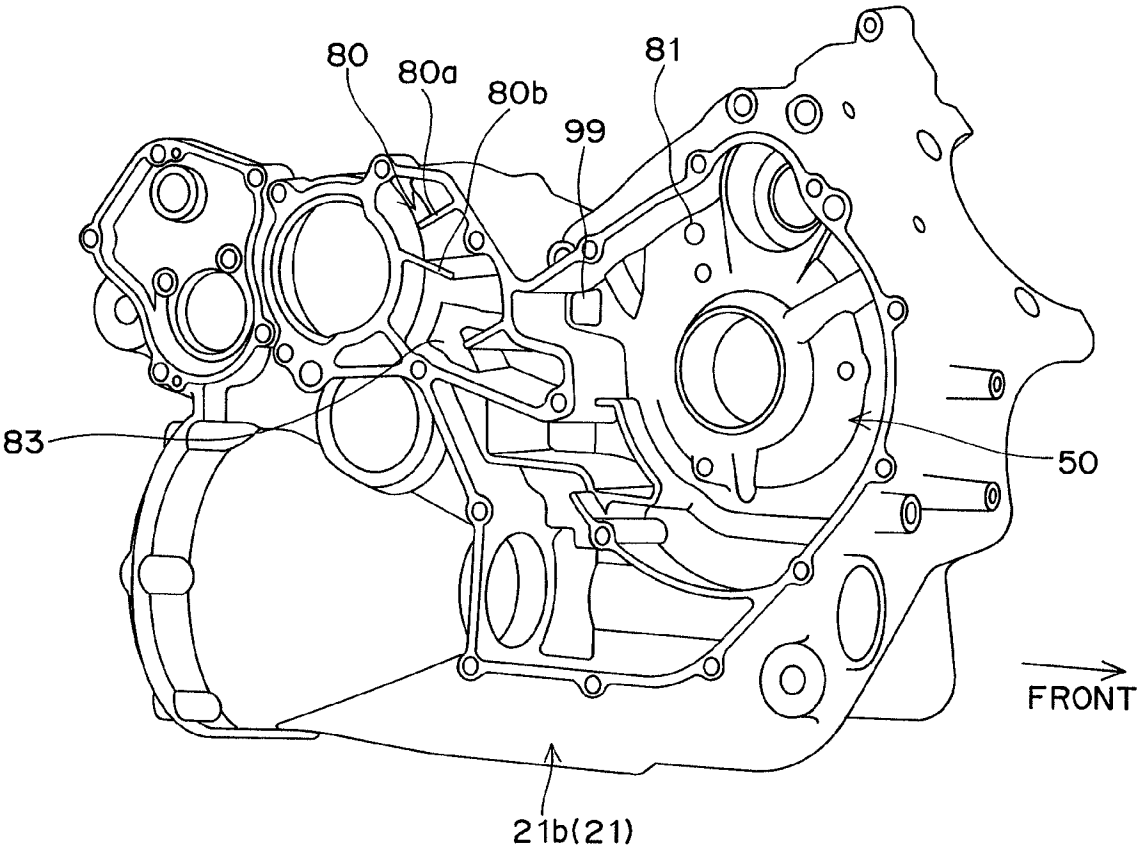
FIG. 8 is a perspective view (an exterior view) of the right crankcase member of the engine in FIG. 1 seen from the right front side.

FIG. 8 is a perspective view of the right crankcase member 21*b* seen from the right front side. Two collision walls 80*a*, 80*b* spaced in the up and down direction are provided in the main breather chamber 80. The upper collision wall 80*a* protrudes rearward as well as slightly downward from a front wall of the breather chamber 80, and the lower collision wall 80*b* protrudes forward as well as slightly upward from a rear wall of the breather chamber 80. These two collision walls 80*a*, 80*b* form a substantially S shape labyrinth or maze in the breather chamber 80. A lower breather passage 83 is provided on the lower side of the main breather chamber 80, and a rear part of the lower breather passage 83 communicates with a lower end of the main breather chamber 80.

Figure 9:
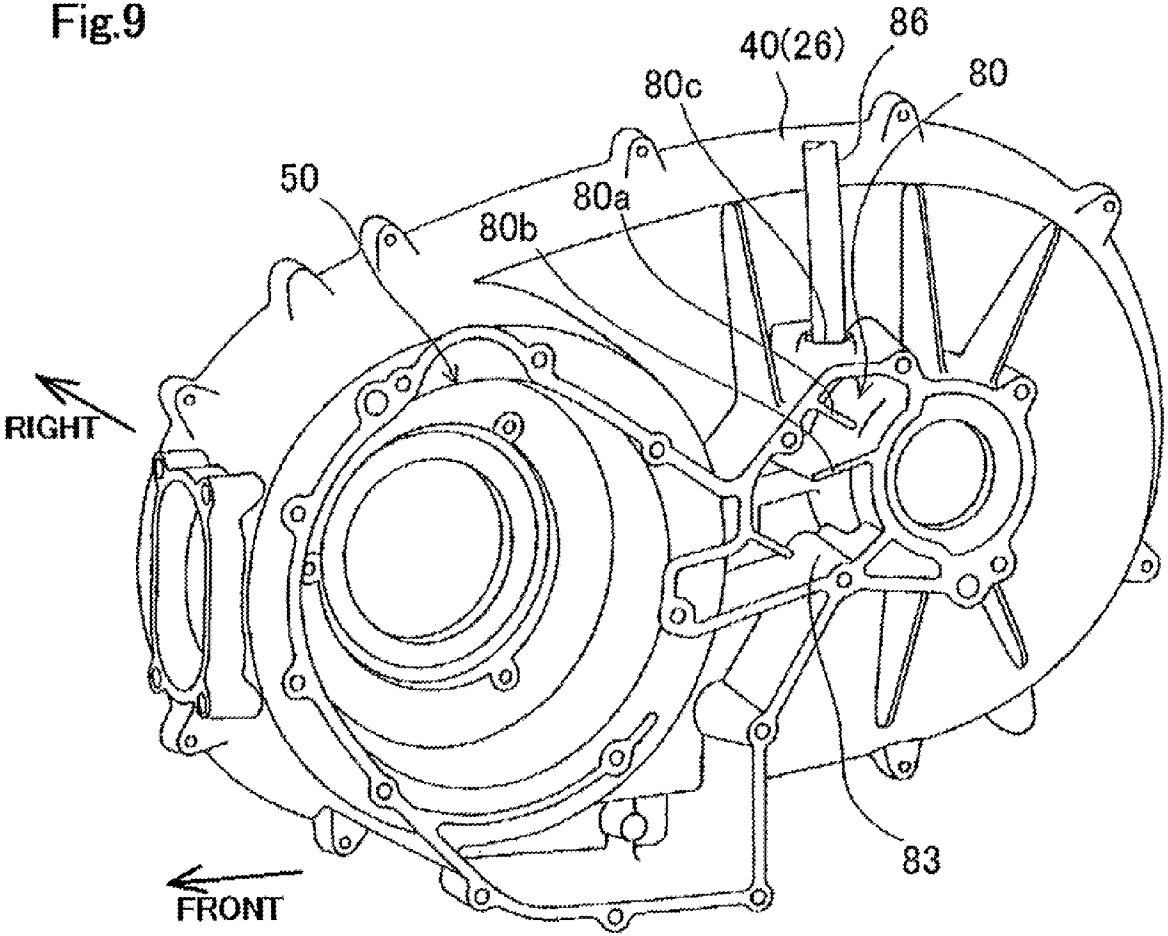
FIG. 9 is a perspective view of a case main body of the engine in FIG. 1 seen from the left front side.

FIG. 9 is a perspective view of the case main body 40 of the V-belt transmission case 26 seen from the left front side. This case main body 40 forms a substantially right half of the main breather chamber 80. Therefore, as well as the right crankcase member 21*b* (FIG. 8), the two collision walls 80*a*, 80*b* spaced in the up and down direction are provided in the main breather chamber 80. Further, a gas component discharge port 80*c* is formed in an upper wall of the main breather chamber 80 of the case main body 40. This gas component discharge port 80*c* communicates with an air intake box of an intake device (not shown) through an outlet tool and a rubber tube 86.

Figure 4:
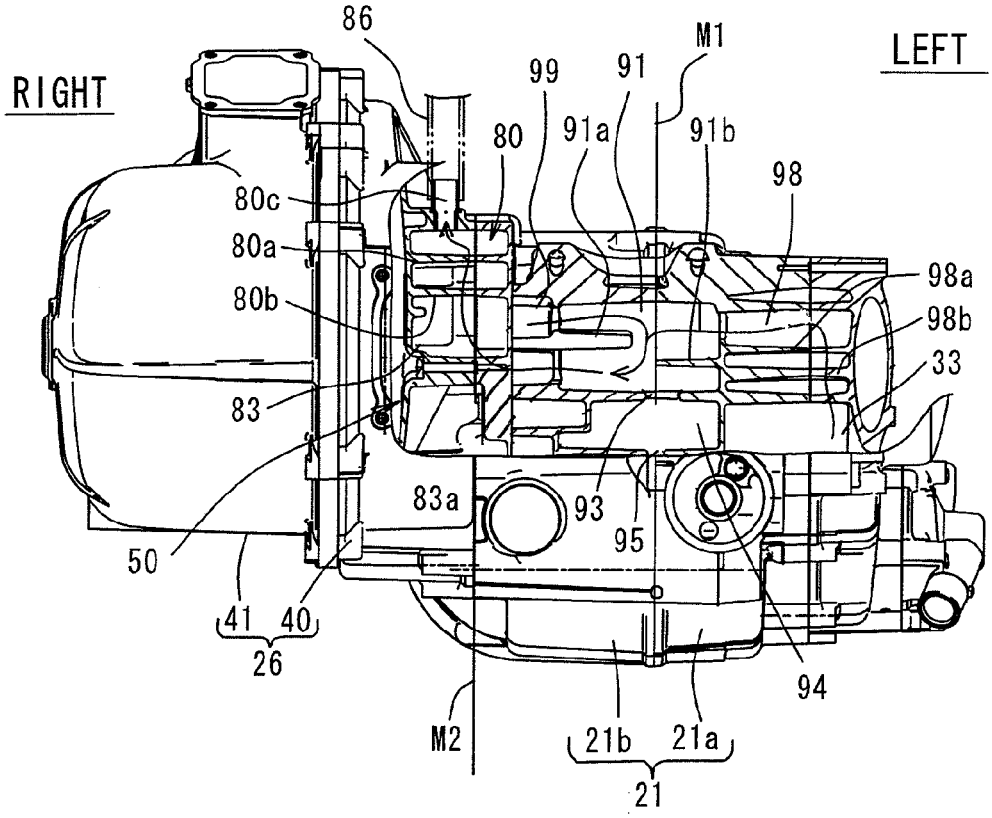
FIG. 4 is a partially sectional front view of the engine in FIG. 1.

FIG. 4 is a partially sectional front view showing the engine in FIG. 1. A pre-breather chamber 91 for gathering the blow-by gas from the clutch chamber 50 on the right side and the generator chamber 33 on the left side and separating the blow-by gas into gas and liquid before gas-liquid separation of the main breather chamber is formed by the mating surfaces M1 of the left and right crankcase members 21*a*, 21*b*.

A left end of an upper part of the pre-breather chamber 91 communicates with the generator chamber 33 through a left breather passage 98, and a right end of the upper part of the pre-breather chamber 91 communicates with the clutch chamber 50 through a right breather passage 99.

A plurality of collision walls 98*a*, 98*b* spaced in the up and down direction are formed in the middle of the left breather passage 98. These collision walls 98*a*, 98*b* form a substantially S shape labyrinth or maze curved in the fore-aft direction in the left breather passage 98.

A plurality of collision walls 91*a*, 91*b* spaced in the up and down direction are also formed in the pre-breather chamber 91. These collision walls 91*a*, 91*b* form a substantially S shape labyrinth or maze curved in the left and right direction in the pre-breather chamber 91.

A right end of a lower part of the pre-breather chamber 91 communicates with the lower breather passage 83 on the lower side of the main breather chamber 80 through an intermediate passage 83*a*.

A discharge passage 94 for discharging an oil component after the gas-liquid separation is formed on the lower side of the pre-breather chamber 91. An upper end of the discharge passage 94 communicates with the pre-breather chamber 91 through a first oil discharge hole 93, and a second oil discharge hole 95 is formed in a lower end of the discharge passage 94.

Figure 7:
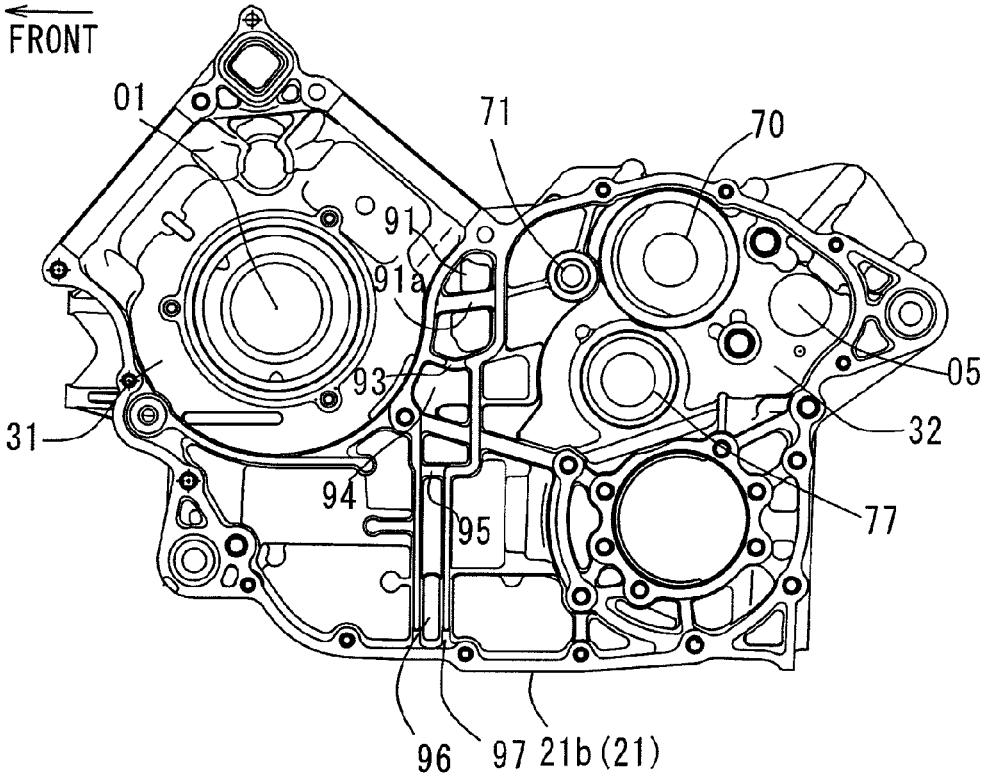
FIG. 7 is a left side view (an interior view) of the right crankcase member of the engine in FIG. 1.

FIG. 7 is a left side view of the right crankcase member 21*b*. The second oil discharge hole 95 provided in a lower wall of the discharge passage 94 communicates with an oil passage 96. The oil passage 96 extends downward and communicates a lower end of the transmission chamber 32 through an oil hole 97 formed in a lower end of the oil passage 96. The oil discharge holes 93, 95 and the oil passage 96 are formed by the mating surfaces Ml of the left and right crankcase members 21*a*, 21*b*.

(Operation)

(1) In FIG. 3, when the engine is driven, a pressure change is generated in the crank chamber 31 due to upward and downward movement of a piston and rotation of the crankshaft 30, and the blow-by gas leaked from a gap between the piston and the cylinder is stored in the crank chamber 31.

(2) When pressure is increased in the crank chamber 31, the blow-by gas containing oil mist flows from the crank chamber 31 into the generator chamber 33 and the clutch chamber 50 through the left and right communication holes 82, 81. It should be noted that the blow-by gas immediately after leakage from the gap between the piston and the cylinder contains a small amount of a mist component, since the contained component is almost fuel. However, when the blow-by gas passes through the crank chamber 31 and other chambers, the oil component such as lubricating oil is mixed into the blow-by gas. Thus, the blow-by gas becomes "mix gas" containing a large amount of the oil component. In the description, all the gas is called as the "blow-by gas" irrespective of a degree of oil content as described above for simplifying the description.

Figure 5:
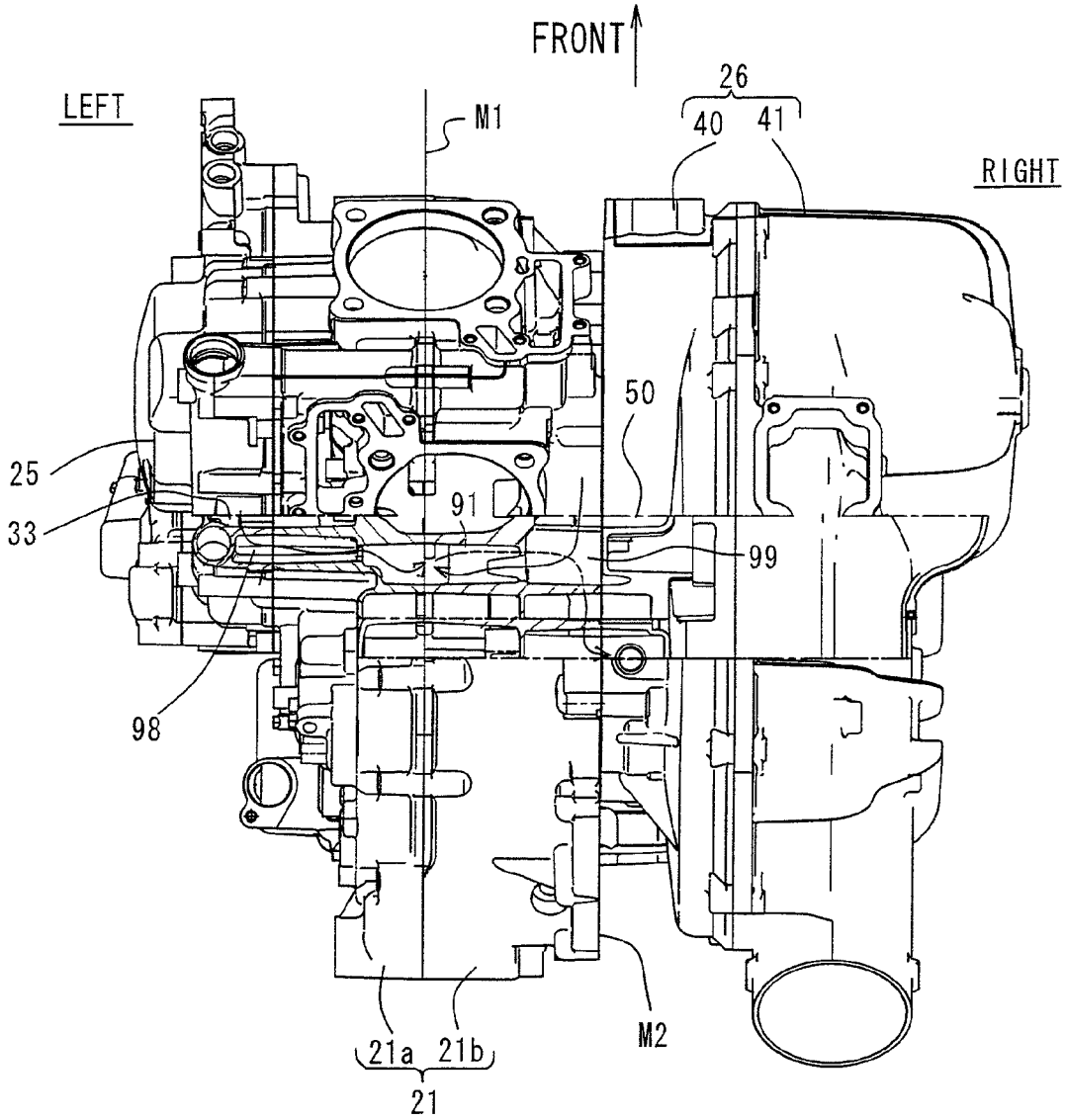
FIG. 5 is a partially sectional plan view of the engine in FIG. 1.

(3) In FIG. 5, the blow-by gas in the clutch chamber 50 on the right side enters the pre-breather chamber 91 on the center through the right breather passage 99, and the blow-by gas in the generator chamber 33 on the left side enters the pre-breather chamber 91 on the center through the left breather passage 98.

(4) In FIG. 4, the blow-by gas gathered in the pre-breather chamber 91 on the center from the left and right sides flows downward in the pre-breather chamber 91 and collides with the collision walls 91*a*, 91*b*, so that part of the oil component is separated. The separated oil component is discharged to the lower end of the transmission chamber 32 through the first oil discharge hole 93, the discharge passage 94, the second oil discharge hole 95, the oil passage 96, and the oil hole 97 shown in FIG. 7.

(5) Meanwhile, the blow-by gas after the separation of the part of the oil component in the pre-breather chamber 91 flows into the main breather chamber 80 from the lower side through the intermediate passage 83*a* and the lower breather passage 83 in FIG. 4.

(6) In FIG. 9, the blow-by gas rising in the main breather chamber 80 successively collides with the collision walls 80*b*, 80*a* so as to be separated into the gas component and the oil component. The gas component after the separation is discharged from the gas component discharge port 80*c* in an upper end of the breather chamber to the air intake box of the air intake device (not shown) or the atmosphere through the rubber tube 86. Meanwhile, the oil component after the separation flows down to the lower breather passage 83 in the lower end of the breather chamber and is discharged to the lower end of the transmission chamber 32 through the first oil discharge hole 93, the discharge passage 94, the second oil discharge hole 95, the oil passage 96, and the oil hole 97 in FIG. 7.

(Effect of First Embodiment)

According to the embodiment, (1) the breather chamber 80 is formed by the mating surfaces M2 of the crankcase 21 and the V-belt transmission case 26 attached to the side of the crankcase 21. Therefore, it is possible to form the breather chamber 80 without increasing size in the up and down direction, the fore-aft direction and the left and right direction of the engine. Moreover, since a case and a cover exclusive for forming the breather chamber are not required, it is possible to reduce the number of parts, part cost and manufacturing cost.

(2) The reverse idle gear 75 of the gear-type transmission T2 is placed on the opposite side of the V-belt continuously variable transmission T1, and the breather chamber 80 is arranged between the front and rear pulleys 62, 64 of the V-belt type transmission T1 so as to face the reverse idle gear 75. Therefore, it is possible to maintain compact width of the engine in the left and right direction while ensuring the large-capacity breather chamber 80.

(3) The blow-by gas discharged from the crank chamber 31 to the clutch chamber 50 and the generator chamber 33 is once gathered in the pre-breather chamber 91 formed in a center part of the crankcase 21 in the left and right direction, and then fed to the main breather chamber 80. Therefore, the oil mist scattered in the clutch chamber 50 and the generator chamber 33 does not directly enter the main breather chamber 80. Since the pre-breather chamber 91 is provided in addition to the main breather chamber 80, a gas-liquid separation function is enhanced.

(4) The gas component discharge port 80*c* of the main breather chamber 80 is formed in the case main body 40 of the V-belt transmission case 26, the rubber tube 86 to be connected to the gas component discharge port 80*c* can be placed distant from an exhaust tube of the rear cylinder 23*a* of the V-type engine. Thus, it is possible to reduce a thermal influence from the exhaust tube.

(5) As shown in FIG. 7, the oil passage 96 for returning the oil component separated from the blow-by gas to the transmission chamber 32 is formed integrally with the crankcase 21 and extends to the lower end of the transmission chamber 32. Thus, since there is no need for arranging an oil tube which is a separate body from the crankcase 21, it is possible to reduce the number of the parts.

[Second Embodiment of the Invention]

Figure 10:
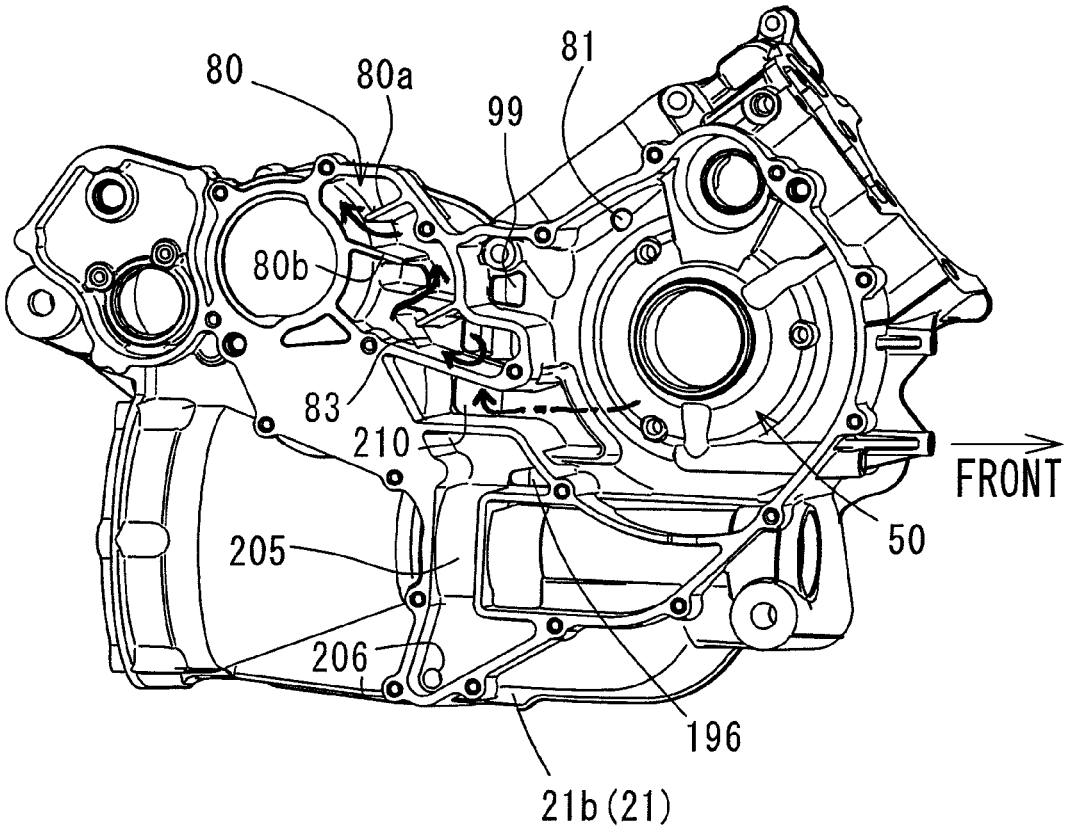
FIG. 10 is a right side view (an exterior view) of a right crankcase member of an engine according to another embodiment.
Figure 11:
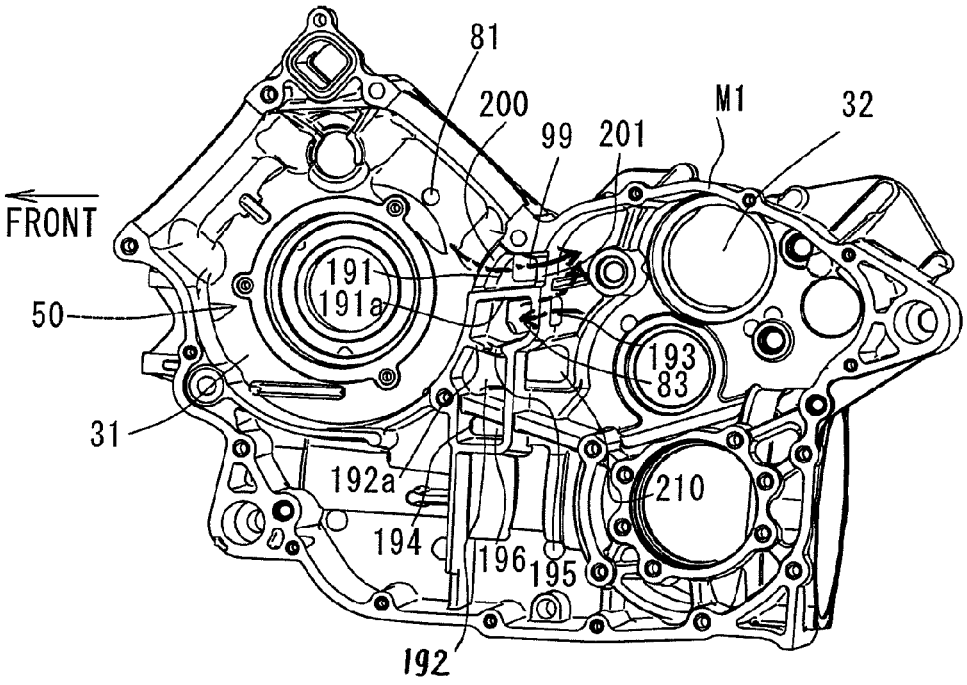
FIG. 11 is a left side view (an interior view) of the right crankcase member of the engine in FIGS. 10.
Figure 12:
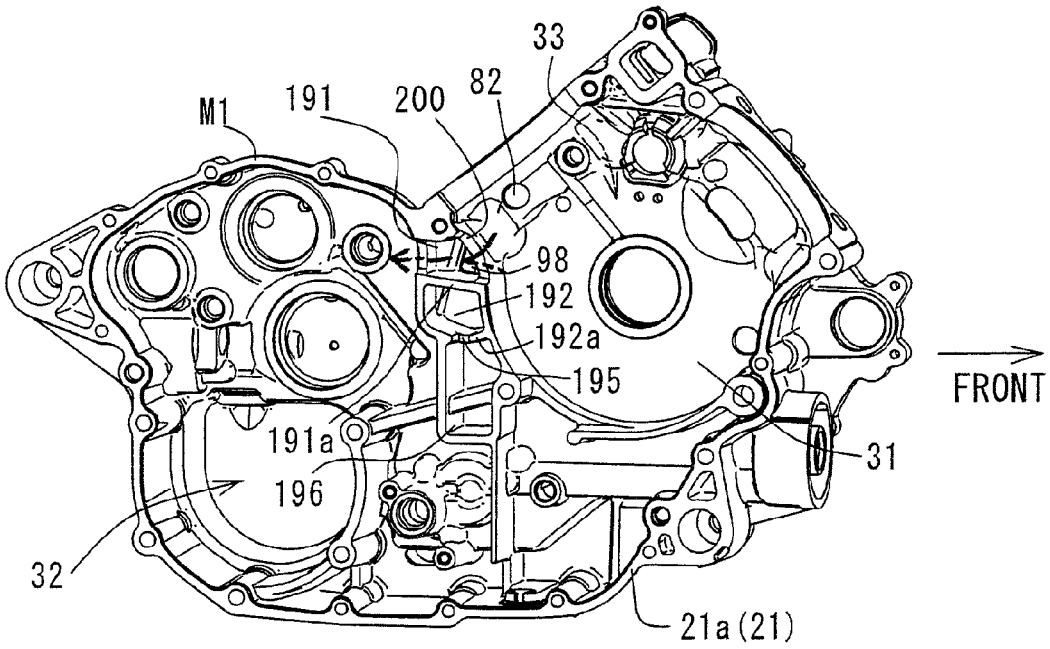
FIG. 12 is a right side view (an interior view) of a left crankcase member of the engine in FIG. 10.

FIGS. 10 to 12 show a second embodiment of the present invention. FIG. 10 is a right side view (an exterior view) of the right crankcase member 21*b*. FIG. 11 is a left side view (an interior view) of the right crankcase member 21*b*. FIG. 12 is a right side view (an interior view) of the left crankcase member 21*a*.

In the second embodiment, structures other than the breather structure are the same as the first embodiment, and in the breather structure, the structure of the main breather chamber 80 is the same as the first embodiment. The same parts and components as the first embodiment will be given the same reference numerals.

In FIG. 10, the main breather chamber 80 is formed by the mating surfaces M2 of the right side surface of the right crankcase member 21*b* and the V-belt transmission case 26 (refer to FIG. 4). The right crankcase member 21*b* forms the substantially left half of the main breather chamber 80. The main breather chamber 80 is positioned so as to face the reverse idle gear (refer to the reference numeral 75 in FIG. 3) seen in the crankshaft direction as described above.

The two collision walls 80*a*, 80*b* spaced in the up and down direction are provided in the main breather chamber 80. The upper collision wall 80*a* protrudes rearward from the front wall of the breather chamber 80, and the lower collision wall 80*b* protrudes forward from the rear wall of the breather chamber 80. These two collision walls 80*a*, 80*b* form the substantially S shape labyrinth or maze in the breather chamber 80. The lower breather passage 83 is provided on the lower side of the main breather chamber 80, and the rear part of the lower breather passage 83 communicates with the lower end of the main breather chamber 80.

In FIGS. 11 and 12, a gas gathering chamber 191 in which the blow-by gas form the crank chamber 31 is gathered is formed by the mating surfaces M1 of the left and right crankcase members 21*a*, 21*b*. A left end of the gas gathering chamber 191 communicates with the generator chamber 33 through the left breather passage 98, and a right end of the gas gathering chamber 191 communicates with the clutch chamber 50 through the right breather passage 99. A front end of the gas gathering chamber 191 communicates with the crank chamber 31 through a breather hole 200, and a rear end of the gas gathering chamber 191 communicates with the transmission chamber 32 through a breather hole 201.

An intermediate passage 192 is formed on the lower side of the gas gathering chamber 191 across a lower wall 191*a*. A right end of the intermediate passage 192 communicates with the lower breather passage 83 of the main breather chamber 80, and a rear end of the intermediate passage 192 communicates with the transmission chamber 32 through a breather hole 193.

An oil chamber 194 is formed on the lower side of the intermediate passage 192 across a lower wall 192*a*. An oil discharge hole 195 is formed in the lower wall 192*a*, and the intermediate passage 192 communicates with the oil chamber 194 (FIG. 11) through this oil discharge hole 195.

An oil hole 196 is formed in a right side wall of the oil chamber 194. The oil chamber 194 communicates with an oil passage 205 formed in the right crankcase member 21*b* shown in FIG. 10 through the oil hole 196.

The oil passage 205 is formed by the mating surfaces of the right crankcase member 21*b* and the V-belt transmission case (corresponding to the reference numeral 26 in FIG. 9). The oil passage 205 extends to a lower end of the crankcase 21, and communicates with the transmission chamber 32 through an oil hole 206.

It should be noted that a passage 210 for directly discharging the blow-by gas from the crank chamber 31 to the transmission chamber 32 is also formed in FIG. 11.

(Operation)

(1) As well as the first embodiment, in FIGS. 11 and 12, part of the blow-by gas containing the oil mist stored in the crank chamber 31 flows into the generator chamber 33 and the clutch chamber 50 through the left and right communication holes 82, 81. Part of the remaining blow-by gas directly flows into the gas gathering chamber 191 through the breather hole 200 on the front side in FIG. 11, and another part of the remaining blow-by gas flows into the transmission chamber 32 through the passage 210 on the lower side.

(2) The blow-by gas flowing into the clutch chamber 50 and the generator chamber 33 flows into the gas gathering chamber 191 on the center through the left and right breather passages 98, 99.

(3) The blow-by gas gathered in the gas gathering chamber 191 once flows into the transmission chamber 32 through the breather hole 201 on the rear side, and then flows into the intermediate passage 192 through the breather hole 193 on the lower side. The blow-by gas directly flowing into the transmission chamber 32 from the crank chamber 31 through the passage 210 also flows into the intermediate passage 192.

(4) Part of the oil component is separated from the blow-by gas in the intermediate passage 192. The blow-by gas after the separation of the part of the oil component flows into the lower breather passage 83 of the main breather chamber 80, and the separated part of the oil component drops down to the oil chamber 194 through the oil discharge hole 195.

(5) In FIG. 10, the blow-by gas flowing into the lower breather passage 83 rises in the main breather chamber 80 and successively collides with the collision walls 80*b*, 80*a* so as to be separated into the gas component and the oil component. The gas component after the separation is discharged from the upper end of the breather chamber 80 to the air intake box of the air intake device or the atmosphere through the rubber tube 86 (refer to FIG. 4) as well as the first embodiment. Meanwhile, the oil component after the separation is discharged to the intermediate passage 192 in FIG. 11 and drops down to the oil chamber 194 through the oil discharge hole 195.

(6) The oil component dropping down to the oil chamber 194 is discharged to the transmission chamber 32 through the oil hole 196, the oil passage 205 and the oil hole 206 on a lower end in FIG. 10.

In the second embodiment, the oil passage 205 for discharging the oil component to the transmission chamber 32 is also formed by the mating surfaces M2 of the right crankcase member 21*b* and the V-belt transmission case 26 as well as the main breather chamber 80. Therefore, it is possible to ensure further large internal space of the crankcase 21.

[Other Embodiments]

(1) The present invention is not limited to the V-type engine but may be applied to a plural-cylinder inline engine or a single-cylinder inline engine. The present invention is not limited to the four-wheeled vehicle but may be utilized as an engine for a motorcycle.

(2) The present invention is not limited to the structures of the embodiments described above but includes various modifications within a scope not departing from the claims.

What is claimed is:

1. A two-cylinder engine for a vehicle, the engine comprising:

a front cylinder inclined forward and a rear cylinder inclined rearward, the front cylinder and the rear cylinder being arranged in a V configuration with a V bank between the front cylinder and the rear cylinder;

a rear idle shaft;

a crankshaft;

a gear type transmission having an input shaft;

a V-belt type continuously variable transmission for transmitting mechanical power from the crankshaft to the input shaft of the gear type transmission, the V-belt type continuously variable transmission having a drive shaft, a drive pulley attached to the drive shaft, a driven shaft, and a driven pulley attached to the driven shaft;

a crankcase constituted by left and right crankcase members, the crankcase having a crank chamber and a gear transmission chamber disposed behind the crank chamber in the crankcase, the crank chamber housing the crankshaft, and the gear transmission chamber housing the gear type transmission;

a V-belt transmission case housing the V-belt type continuously variable transmission, the V-belt transmission case being formed independently from the crankcase and being fastened to an attachment surface on one side of the crankcase in the crankshaft direction;

a V-belt transmission chamber housed by the V-belt transmission case;

a main breather chamber formed in a mating part between the attachment surface of the crankcase and an attached surface of the V-belt transmission case, the main breather chamber separating the air containing oil mist in the crankcase into a gas component and an oil component, discharging the gas component to the exterior of the crankcase through a discharge port, and returning the oil component to the interior of the gear transmission chamber;

a pre-breather chamber arranged on a lower side of the main breather chamber, the pre-breather chamber being formed by a mating surface of the left and right crankcase members, and the pre-breather chamber gathering blow-by gas and feeding into the main breather chamber; and an oil discharge passage formed in the crankcase so as to extend from the pre-breather chamber downward to a lower end of the gear transmission chamber;

a clutch chamber housing a centrifugal clutch for turning ON/OFF mechanical power transmission from the crankshaft to the V-belt type continuously variable transmission on one side of the crank chamber in the crankshaft direction; and a generator chamber housing a generator on the other side of the crank chamber, the clutch chamber, the generator chamber and the crank chamber communicating with each other through communication holes, wherein the V-belt transmission case is detachably fastened to the crankcase, wherein the discharge port for discharging the gas component of the air containing oil mist after separation from the oil component is formed in the V-belt transmission case, wherein the main breather chamber has a first wall and a second wall, the first wall being a portion of the crankcase and the second wall being a portion of the V-belt transmission case, wherein the main breather chamber is located in the vicinity of a bottom of the V bank, between the drive shaft and the driven shaft of the V-belt type continuously variable transmission in a fore-aft direction, and is located on a position corresponding to the rear idle shaft in a crankshaft direction, wherein the V-belt transmission chamber is arranged on a position corresponding to the rear idle shaft in a crankcase direction, wherein the pre-breather chamber is formed in a center part of the crankcase in the width direction of the vehicle, and wherein blow-by gas from the clutch chamber and the generator chamber is firstly gathered in the pre-breather chamber and then fed to the main breather chamber.

2. The engine for the vehicle according to claim 1, wherein the gear type transmission includes a reverse gear row in the vicinity of a side wall thereof on the opposite side of the V-belt transmission case, and wherein the main breather chamber is positioned so as to face the reverse gear row in the crankshaft direction.

3. The engine of claim 1, wherein the drive pulley of the V-belt type continuously variable transmission is positioned on the side of the crankshaft, the driven pulley of the V-belt type continuously variable transmission is positioned on the side of the input shaft, and a V-belt looped over the drive pulley and the driven pulley, and wherein the main breather chamber is positioned between the drive pulley and the driven pulley in a direction radial direction of the input shaft.

4. The engine of claim 1, wherein a gas component discharge port for discharging the gas component after separation is formed in the V-belt transmission case.

5. The engine of claim 1, wherein the rear idle shaft has a reverse idle gear, wherein the input shaft of the gear type transmission has an input reverse gear, and wherein the reverse idle gear meshes with the input reverse gear.

6. The engine of claim 1, wherein the oil discharge passage is formed by the mating surfaces of the left and right crankcase members, and the oil discharge passage is opened into a lower portion of the gear transmission chamber via an oil hole.

7. The engine of claim 1, wherein the rear idle shaft is reduced in its axial direction.

* * * * *